US005669855A

United States Patent [19]

Dunn, Jr. et al.

[11] Patent Number: 5,669,855

[45] Date of Patent: Sep. 23, 1997

[54] VERTICALLY MOVABLE RECREATIONAL EQUIPMENT DEVICE

[75] Inventors: James O. Dunn, Jr.; Grant M. Strawcutter; Jonathan E. Brooks, all of Charlotte; Todd A. Coble, Stanfield, all of N.C.

[73] Assignee: Soft Play, L.L.C., Charlotte, N.C.

[21] Appl. No.: 634,044

[22] Filed: Apr. 17, 1996

[51] Int. Cl.[6] ..... A63B 9/00

[52] U.S. Cl. ..... 482/35; 482/36

[58] Field of Search ..... 482/35, 36, 23, 482/24; 472/95, 103, 104, 105, 116, 118, 135, 136, 77; 434/55, 58, 59, 247

[56] References Cited

U.S. PATENT DOCUMENTS

| | | | |
|---|---|---|---|
| 2,705,144 | 3/1955 | Ridgway | 472/116 X |
| 3,578,381 | 5/1971 | Young . | |
| 3,886,607 | 6/1975 | Dunn | 472/135 |
| 3,936,140 | 2/1976 | Ahrens . | |
| 4,379,550 | 4/1983 | Petersen . | |
| 4,995,603 | 2/1991 | Reed . | |
| 5,062,624 | 11/1991 | Reed . | |
| 5,226,864 | 7/1993 | Showers | 482/35 |
| 5,387,165 | 2/1995 | Warren | 482/35 |

OTHER PUBLICATIONS

Miracle Recreation Equipment Company 1995 Park & Playground Catalog, pp. 79–80.

Soft Play, L.L.C.'s 1995 "Value Series" brochure dated 1995.

*Primary Examiner*—Richard J. Apley

*Assistant Examiner*—William LaMarca

*Attorney, Agent, or Firm*—Polster, Lieder, Woodruff & Lucchesi, lc

[57] ABSTRACT

A movable recreational equipment device is disclosed. The device includes an enclosure having at least one opening for entry of an occupant and a support for suspending the enclosure above a floor or ground surface. The support and enclosure are constructed and connected to one another to restrict movement of the enclosure in a first predetermined path. The enclosure has controlled fluid or resilient mounting relative to the support in a second predetermined path in order to permit controlled fluid or resilient movement of the enclosure relative to the support in the second predetermined path, when an occupant enters the enclosure. Preferably, the first predetermined path, in which movement of the enclosure relative to the support is restricted, is a horizontal path while the second predetermined path, enabling controlled fluid or resilient movement of the enclosure relative to the support, is a vertical path. The device may be connected to one or more flexible tubes in a recreational play system environment to enable movement of the enclosure while remaining connected to the tubes.

15 Claims, 3 Drawing Sheets

VERTICALLY MOVABLE RECREATIONAL EQUIPMENT DEVICE

CROSS REFERENCE TO RELATED APPLICATIONS

This is a copending patent application of the following commonly assigned patent application Ser. No. 08/633,462, filed Apr. 17, 1996 entitled MULTI-DIRECTIONAL MOVABLE RECREATIONAL EQUIPMENT DEVICE, Ser. No. 08/633,587, filed Apr. 17, 1996 entitled LATERALLY MOVABLE RECREATIONAL EQUIPMENT DEVICE, Ser. No. 08/633,662, filed Apr. 17, 1996 entitled MOVABLE OCCUPANT DIRECTED RECREATIONAL EQUIPMENT DEVICE, and Design patent application Ser. No. 29/055,394, filed Jun. 5, 1996 entitled MOVING RECREATIONAL EQUIPMENT COMPONENT; now U.S. Pat. No. Des. 381,386.

BACKGROUND OF THE INVENTION

Children's outdoor playground or recreational equipment that facilitates movement is quite popular. In addition to swing sets, rotating or whirling devices and teeter-totters, children love to sit on spring mounted riders that have various animal and other shapes. Typically, such spring mounted riders have coil springs or leaf springs that extend between the ground and the rider. As a result, children can sit on the rider and create their own bouncing and rocking movements. Examples of such devices are shown in U.S. Pat. Nos. 3,578,381; 3,836,140; 4,379,550; and in the Miracle Recreation Equipment Company 1995 Park and Playground Catalog at pages 79–80.

Children's indoor playground or recreational equipment does not readily offer various moving type play devices. Space, along with safety, restricts the availability of various types of movable recreational equipment. This is also true of tubular play systems and enclosures through which children crawl or move, such as shown, for example, in Soft Play, L. L. C.'s 1995 "Value Series" brochure. Where an indoor recreational play system includes such tube and junction boxes or other enclosures through which children crawl or move, it would be desirable to provide movement of the junction box, enclosures or other elements. Although children enjoy being confined in a mirage or tubes and enclosures in such tubular play equipment, in order to create a more interesting environment, it has been discovered that it is possible to provide for movement of the enclosures or other elements, while enabling such elements to remain connected to generally flexible components in the tubular play equipment.

There are some rotating and tilting enclosures which are separate, free standing devices, including for example, U.S. Pat. Nos. 4,995,603 and 5,062,624. However, when enclosures are part of a recreational play system that includes connected tubes and enclosures, it would be particularly desirable to provide for movement of the enclosures or other elements, while enabling same to remain connected to generally non-moving tubes or other components in the tubular play equipment.

The present invention relates to a vertically movable recreational equipment device, as distinct from the multi-directional, laterally movable or occupant directed recreational equipment devices as identified in the aforementioned patent application.

SUMMARY OF THE INVENTION

Accordingly, among the several objects and advantages of the present invention include:

The provision of a movable recreational equipment device constructed particularly for movement in a vertical path;

The provision of the aforementioned movable recreational equipment device which allows for movement of the device while remaining connected to various flexible tubular elements or other parts in a tubular play equipment system;

The provision of the aforementioned movable recreational equipment device which provides for controlled fluid or resilient movement of the movable recreational equipment device while being suspended relative to a support;

The provision of the aforementioned movable recreational equipment device in which entry of an occupant provides controlled fluid or resilient movement relative to the support;

The provision of the aforementioned movable recreational equipment device which provides smooth and safe movement in a controlled environment;

The provision of the aforementioned movable recreational equipment device which provides vertical or up and down movement relative to the support, while restricting lateral or sideways movement relative to the support;

The provision of the aforementioned movable recreational equipment device which restricts movement in one predetermined path, while providing for controlled fluid or resilient movement in a second predetermined path; and The provision of the aforementioned movable recreational equipment device which can be quickly and economically manufactured; is easy to use and maintain; is made of a minimum number of parts; is safe in operation; and is otherwise well adapted for the purposes intended.

Briefly stated, the movable recreational equipment device of the present invention includes an enclosure having at least one opening for entry of an occupant. A support suspends the enclosure above a floor or ground surface. The support and enclosure are constructed and connected to one another to restrict movement of the enclosure in a first predetermined path. Means are provided for controlled fluid mounting of the enclosure relative to the support in a second predetermined path in order to permit controlled fluid movement of the enclosure relative to the support in the second predetermined path when an occupant enters the enclosure.

Preferably, the first predetermined path is in a horizontal or lateral direction while the second predetermined path is in a vertical or transverse direction.

For the controlled fluid suspended movement, spring means may be provided for resiliently mounting the enclosure relative to the support in order to permit resilient movement of the enclosure relative to the support in the second predetermined path when an occupant enters the enclosure.

The support may be connected to the enclosure adjacent a lower end of the enclosure to restrict movement in one predetermined path.

Spring means may be connected adjacent an upper end of the enclosure for the resilient mounting and movement of the enclosure relative to the support in the second predetermined path.

Spring means may be connected adjacent both an upper and a lower end of the enclosure. In such instance, the spring means may include at least one coil spring adjacent an upper end of the enclosure and at least one leaf or compression spring adjacent a lower end of the enclosure. In another instance, the spring means may include spaced coil springs adjacent an upper end of the enclosure and spaced leaf or compression springs adjacent a lower end of the enclosure.

The spring means adjacent a lower end of the enclosure, in the form of leaf or compression springs, may comprise U-shaped leaf or compression springs which facilitate movement in the second predetermined path while restricting movement of the enclosure in a first predetermined path.

The support may include first spaced struts connected at an opposite end to second spaced struts with each spaced U-shaped leaf or compression spring connected to one of the first struts adjacent a second shut at one end while each coil spring is connected to one of the first struts adjacent one of the second struts at an opposite end. The first struts may comprise vertical struts while the second shuts may comprise horizontal struts.

The movable recreation equipment device is preferably part of a recreational play system environment including one or more tubes received in complementary shaped openings of the enclosure which provides movement of the enclosure relative to the support without disconnection from generally flexible tubes in the recreational play system environment.

The U-shaped leaf or compression springs have spaced legs and an intermediate bight portion. Each of the spaced legs engage one end of the enclosure or support while the intermediate bight portion may rest on a floor or ground surface, if the device is used by itself. One leg of each of the U-shaped leaf springs preferably engages a vertical strut of the support in a vertically spaced position from one end of one of the spring means that engages the same vertical strut of the support.

These and other objects and advantages of the present invention will become apparent from the description that follows.

BRIEF DESCRIPTION OF THE DRAWINGS

In the drawings.

Corresponding reference numerals will be used throughout the several figures of the drawings.

DESCRIPTION OF THE PREFERRED EMBODIMENTS

The following derailed description illustrates the invention by way of example and not by way limitation. This description will clearly enable one skilled in the art to make and use the invention, and describes several embodiments, adaptions, variations, alternatives and uses of the invention, including what I presently believe is the best mode of carrying out the invention.

Figure 5:
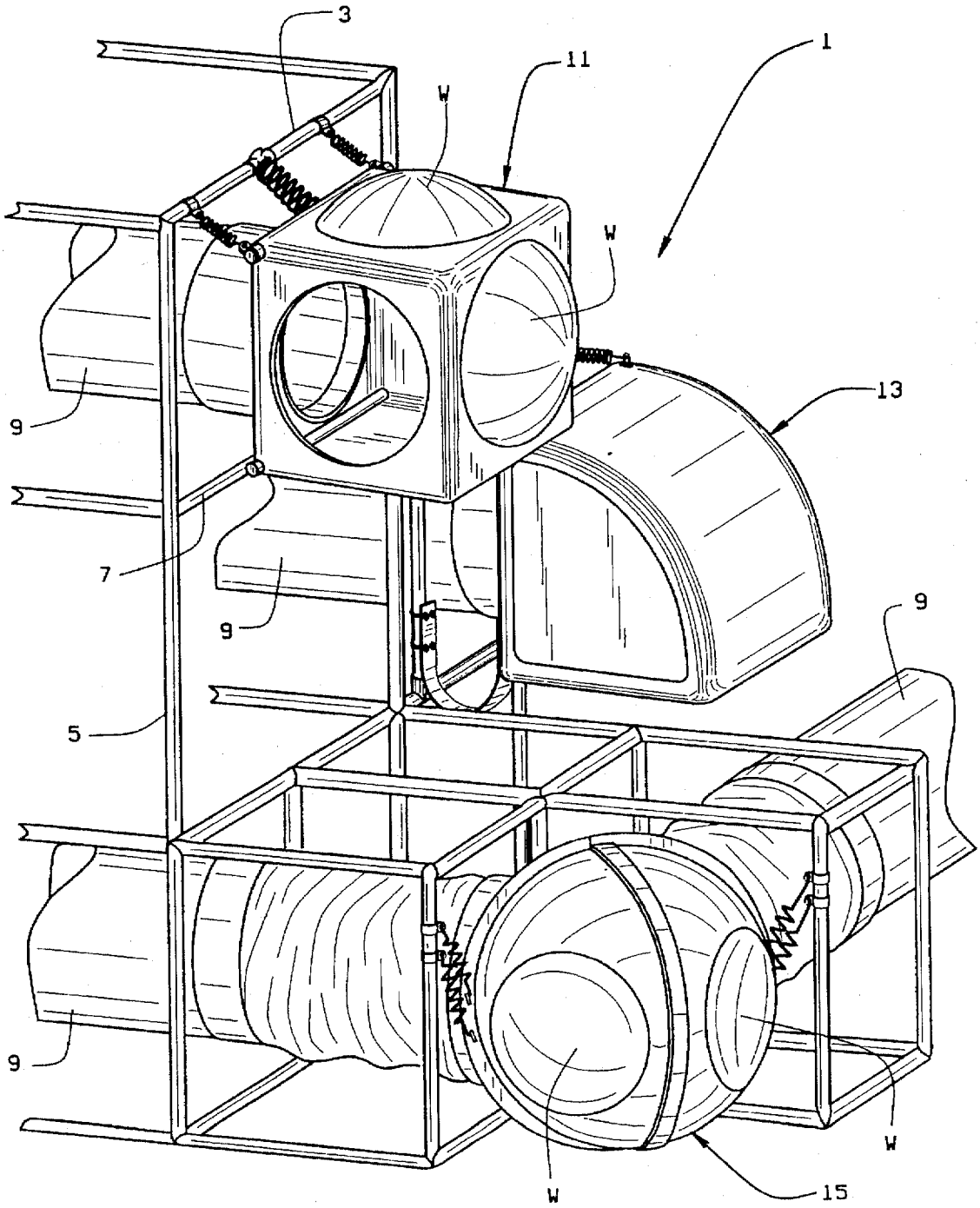
FIG. 5 is a perspective view of a typical tubular play system environment, including a plurality of tubes and enclosures, as well as the movable recreational equipment device of the present invention.

In order to understand a typical and preferred recreational play system in which the movable recreational equipment device of the present invention may be used, reference is first made to FIG. 5 of the drawings.

As illustrated in FIG. 5, a recreational play system 1 may include a supporting structure 3 have a series of interconnected vertical struts 5 and horizontal struts 7 for supporting an interconnected tubular and enclosure play structure. The interconnected tubular and enclosure play structure may include interconnected elongated tubes 9 and enclosures 11, 13, and 15 which are arranged at various respective heights in the supporting structure 3, or in any other desired arrangement. The interconnected tubes 9 and enclosures 11, 13, and 15 enable children to crawl or move through the interconnected tubes and enclosures for a fun play experience. The enclosures 11, 13, and 15 may be connected to one or more tubes 9 and may include the use of transparent windows W in the enclosures, as illustrated in each of the enclosures 11 and 15.

Typically, the enclosures 11, 13, and 15 have been static structures in that they have been attached in a fixed position to the vertical struts 5 and/or horizontal struts 7. However, it is possible to construct the suspended enclosures 11, 13, and 15 in order to provide a safe and controlled fluid or resilient movement in one or more directions, in order to enhance the play experience of children when entering the enclosures 11, 13, and 15. At the same time, the enclosures 11, 13 and 15 remain connected to the tubes 9, preferably flexible tubes, as will become apparent.

Each of the enclosures 11, 13, and 15 are the subject of separate patent applications as follows: enclosure 11 is the subject of copending patent application Ser. No. 08/633,587 filed Apr. 17, 1996 entitled LATERALLY MOVABLE RECREATIONAL EQUIPMENT DEVICE, enclosure 15 is the subject of copending patent application Ser. No. 08/633,462 filed Apr. 17, 1996 entitled MULTI-DIRECTIONAL MOVABLE RECREATIONAL EQUIPMENT DEVICE, and enclosure 13 is the subject of the present patent application and is directed to the movement of the enclosure in a constrained predetermined path, preferably in a generally vertical direction, as will become apparent from the description that follows.

In the discussion that follows, the term "fluid" or "resilient" mounting is defined as a movable and/or changeable mounting structure, and includes resilient devices such as springs or other shock absorbing elements, as well as fluid (air or liquid) cylinders or other structure, which are able to move and change shape without separating under force or pressure. In the same sense, the term "fluid" or "resilient" movement is defined to include movable and/or changeable positions or movement along a predetermined path.

The movable recreational equipment device 13 is best illustrated in FIGS. 1–4 of the drawings and includes an enclosure 17 having a generally quarter cylindrical hollow box shape that is roto-molded from suitable plastic material, polyethylene being one preferred example. As disclosed in U.S. Pat. No. 5,387,165 and copending patent application Ser. No. 08/659,176 filed Jun. 5, 1996 entitled IMPROVED RECREATIONAL EQUIPMENT JUNCTION BOX, the generally quarter cylindrical hollow box shaped enclosure 17 may be modified and configured in various ways to include a different number and location of connected tubes, windows and ventilator panels, as may be desired.

Figure 1:
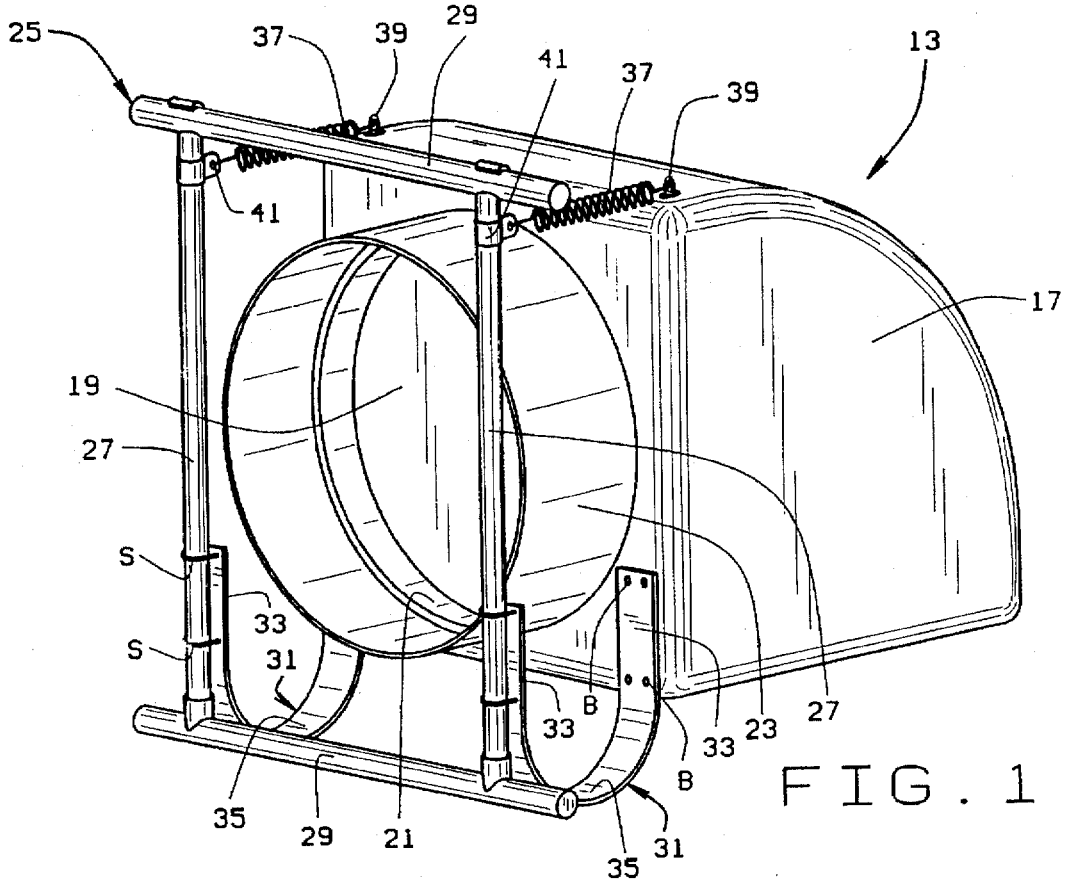
FIG. 1 is a rear perspective view of the movable recreational equipment device of the present invention.
Figure 2:
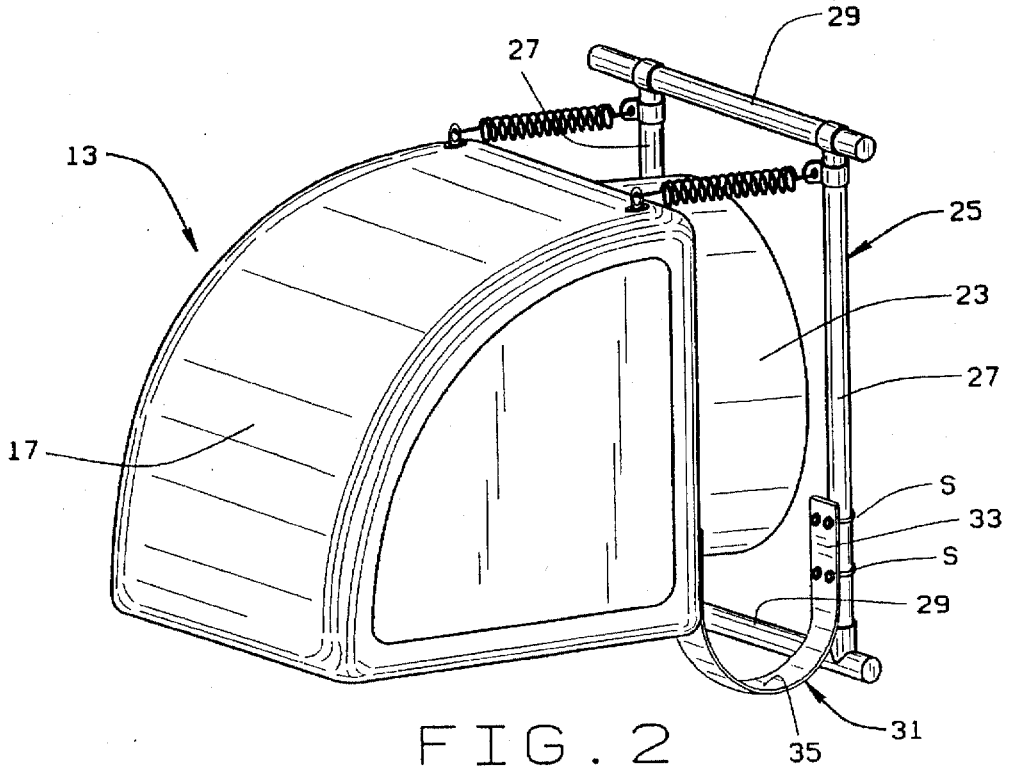
FIG. 2 is a front perspective view of the movable recreational equipment device of the present invention.
Figure 3:
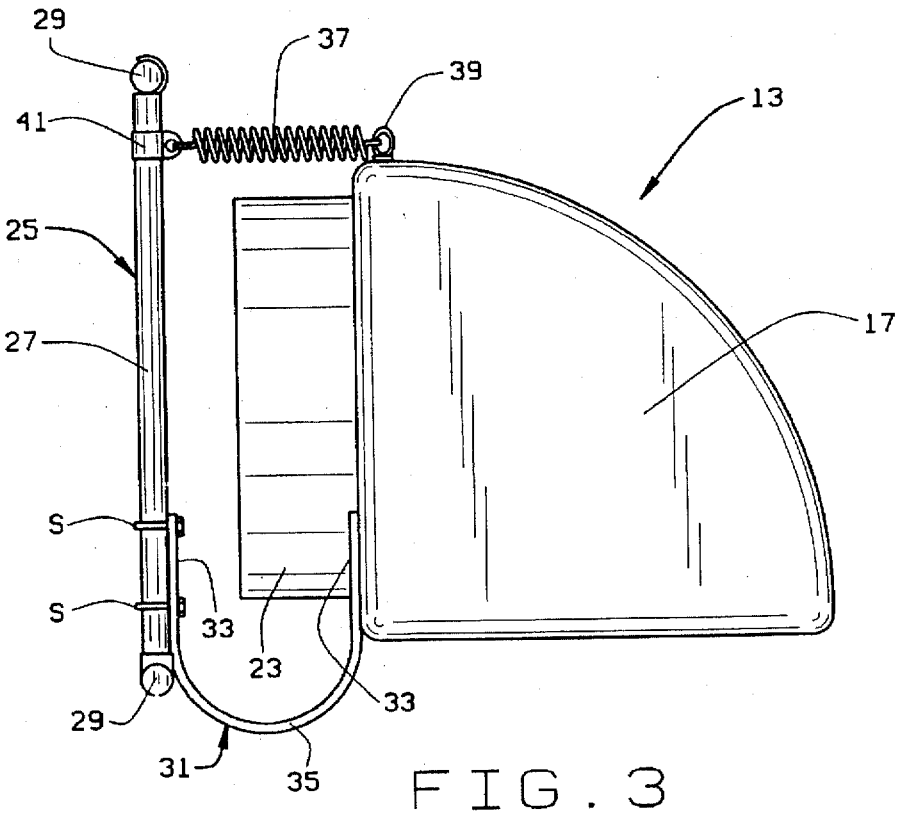
FIG. 3 is a side elevational view of the movable recreational equipment device of the present invention.
Figure 4:
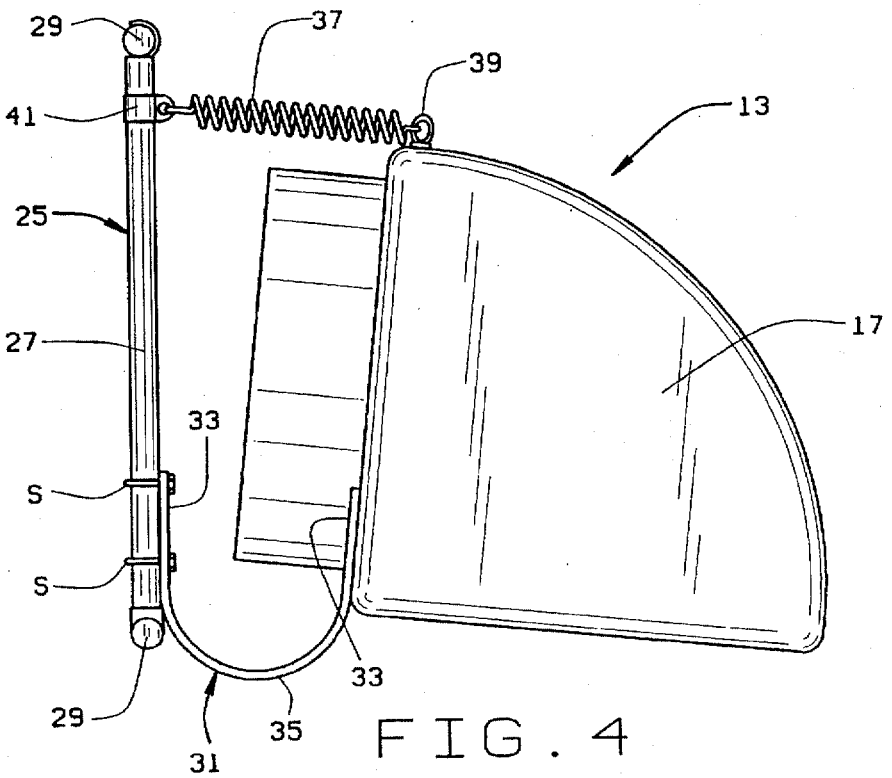
FIG. 4 is a side elevational view similar to FIG. 3, but showing the movable recreational equipment device moving from the position shown in FIG. 3 to a vertically displaced position as illustrated in FIG. 4.

For purposes of the present invention, the enclosure 17 may have any desired shape, as long as it has at least one opening 19 for entry of an occupant. As best illustrated in FIG. 1 of the drawings, the opening 19 formed in the enclosure 17 is surrounded by an integral connective tubular neck 21 with a complementary shaped tube 23 surrounding the connected tubular neck 21. Alternatively, the connective tubular neck 21 may be separately formed from the enclosure 17 and inserted and secured within an opening 19 formed in the enclosure 17. In either instance, the complementary shaped tube 23 is attached to a flexible tube that accommodates movement of the enclosure 17. For this purpose, the flexible tube may be constructed to allow flexing or be made of a material such as webbing that inherently permits flexing, such as the tubes attached to enclosure 15. Also, in addition to the opening 19, the enclosure 17 may be provided with additional openings, in the various other wall sections thereof, as shown in the aforementioned patent and patent application, for receiving flexible tubes, windows, ventilator panels or any other element, as may be desired in the preferred arrangement of the recreational play system 1.

The movable recreational equipment device 13 may be used by itself, as illustrated in FIGS. 1–4 of the drawings; however, preferably it is part of the recreational play system 1 as illustrated in FIG. 5 of the drawings.

The movable recreational equipment device 13 further includes a support 25 for suspending the enclosure 17 above a floor or ground surface. The support 25 includes spaced vertical struts 27, 27 that are interconnected at opposite ends to spaced horizontal struts 29, 29. The enclosure 17 and the support 25 are constructed and connected to one another to restrict movement of the enclosure 17 in a first predetermined path which, as will be seen from the discussion below, is a path that is generally in a horizontal or lateral direction.

In order to provide movement of the enclosure 17 relative to the support 25 in a second predetermined path, the movable recreational equipment device 13 includes means for controlled fluid or resilient mounting of the enclosure 17 relative to the support 25 in a second predetermined path in order to permit controlled fluid or resilient movement of the enclosure 17 relative to the support 25 in the second predetermined path when an occupant enters the enclosure 17.

To restrict movement of the enclosure 17 in a first predetermined path while providing for controlled fluid or resilient movement of the enclosure 17 relative to the support 25 in a second predetermined path, the present invention illustrates spring means for the fluid or resilient mounting of the enclosure 17 relative to the support in order to permit resilient or fluid movement of the enclosure 17 relative to the support 25 in a second predetermined path. The spring means may be connected to the support and enclosure at either and upper or lower end; however, in the illustrated preferred embodiment, such spring means are connected at both an upper and lower end of the enclosure 17.

Specifically, a pair of spaced U-shaped leaf or compression springs 31 are connected at one end adjacent a lower end of the enclosure 17 and also at an opposite end to one of the vertically spaced struts 27 through suitable fasteners as illustrated, for example, in FIGS. 1–4 of the drawings. Each of the U-shaped leaf or compression springs 31 thus have spaced legs 33, 33 and an integral bight portion 35. One of the spaced legs 33 is attached to a lower end of the enclosure 17 by bolts or other suitable fastening elements B while the other spaced leg 33 is attached by fastening straps S or other suitable fasteners to one of the vertical struts 27. The intermediate bight end portion 35 may be used as a supporting leg for resting on a floor surface when the movable recreational equipment device is used by itself, independently of the recreational play system shown in FIG. 5. In either instance, the enclosure 17 will be suspended off of a floor or ground surface while being restricted from moving in a horizontal or lateral direction due to the interconnection of the spaced U-shaped leaf or compression springs with the enclosure 17 and support 25.

At an upper end of the enclosure 17, spaced coil springs 37, 37 are interconnected between an upper end of the enclosure 17 and the spaced vertical struts 27, 27, as illustrated in FIGS. 1–4 of the drawings. For this purpose, a suitable retaining ear 39 is formed or attached at spaced positions in an upper end of the enclosure 17 for connection to one end of a coil spring 37. The other end of each coil spring 37 is attached to the strap 41 and then to one of the spaced vertical struts 27. Suitable soft tubular covering elements, such as vacuum hose, may be used to surround the coil springs 37, 37 to prevent injury, as is well known.

With a movable recreational equipment device constructed as described above, reference is made to FIGS. 3 and 4 for a description of the movement of the enclosure 17 relative to the support 25. Thus, when an occupant enters the opening 19 of the enclosure 17, the weight and/or movement of the occupant causes the enclosure 17 to move from the position shown in FIG. 3 to the position shown in FIG. 4 and then back to the position shown in FIG. 3, as a result of the controlled fluid or resilient movement of the enclosure 17 relative to the support 25. As will be appreciated, the spaced U-shaped leaf or compression springs 31 will restrict lateral or horizontal movement, but will enable the enclosure 17 to move in a generally vertical path, as indicated by comparing the closed and opened positions of one of the U-shaped leaf or compression springs 31 in FIGS. 3 and 4 of the drawings. The upper coil springs 37 are also shown as being moved from a closed to an expanded position, when comparing FIGS. 3 and 4 of the drawings, in order to allow the controlled fluid or resilient movement of the enclosure 17 relative to the support 25, from the FIG. 3 to the FIG. 4 position and then return back to the FIG. 3 position, in a repeated sequence. This is, of course dependent, in part, on the weight and/or movement of an occupant within the enclosure 17. In addition, the controlled fluid or resilient movement of the enclosure 17 relative to the support 25 is also dependent upon the relative strength and resiliency of the U-shaped leaf or compression springs 31 and the coil springs 37. In any case, an appropriate balance can be struck for the aforementioned springs in order to accommodate an average weight of typical occupants that would enter the enclosure 17, as will be appreciated.

From the foregoing, it will now be appreciated that the movable recreational equipment device of the present invention, whether used independently or in conjunction with the recreational play system illustrated in FIG. 5 of the drawings, provides a smooth, safe and controlled fluid or resilient movement of an enclosure 17 relative to the support 25 in a predetermined path. Such path is preferably vertically directed, and is generally transverse to a second or horizontal path, where movement between the enclosure 17 and support 25 is restricted. Movement of the enclosure is also accomplished without separation from other components in a recreational play system environment.

In view of the above, it will be seen that the several objects and advantages of the present invention have been achieved and other advantageous results have been obtained.

As various changes could be made in the above constructions without departing from the scope of the invention, it is intended that all matter contained in the above description or shown in the accompanying drawings shall be interpreted as illustrative and not in a limiting sense.

We claim:

1. A movable recreational equipment device, including:

an enclosure having multiple sides and an opening in one side for entry of an occupant;

proximate support structure immediately adjacent only the one side of the enclosure having the opening for suspending the enclosure above a floor surface;

said support and enclosure being constructed and connected to one another to facilitate movement of the enclosure relative to the proximate support in a vertical path while restricting movement in a lateral path; and spring means extending between the one side of the enclosure having the opening and the proximate support structure for resilient mounting of the enclosure relative to the proximate support structure in the vertical path in order to permit resilient movement of the enclosure relative to the support in the vertical path when an occupant enters the enclosure.

2. The device as defined in claim 1 in which the support is connected to the enclosure adjacent a lower end of the enclosure to restrict movement in one predetermined path.

3. The device as defined in claim 1 in which spring means are connected adjacent an upper end of the enclosure.

4. The device as defined in claim 1 in which spring means are connected adjacent both an upper end and a lower end of the enclosure.

5. The device as defined in claim 4 in which the spring means adjacent an upper end of the enclosure includes at least one coil spring and the spring means adjacent a lower end includes at least one leaf spring.

6. The device as defined in claim 4 in which the spring means adjacent an upper end of the enclosure includes spaced coil springs and the spring means adjacent a lower end of the enclosure includes spaced leaf springs.

7. The device as defined in claim 1 in which the spring means include spaced U-shaped leaf springs connected adjacent a lower end of the support and enclosure for resilient movement in the vertical path while restricting lateral movement of the enclosure, and spaced coil springs connected adjacent an upper end of the support and enclosure to also facilitate resilient movement of the enclosure in the vertical path.

8. The device as defined in claim 7 in which the support includes spaced first struts connected at an opposite end to spaced second struts, and each spaced U-shaped leaf spring connected to one of the first struts adjacent one second strut at one end while each coil spring is connected to one of the first struts adjacent another of the second struts adjacent an opposite end.

9. The movable recreational equipment device as defined in claim 8 in which the first struts are vertical struts and the second struts are horizontal struts.

10. The movable recreational equipment device as defined in claim 1 in which one or more flexible tubes are connected to the enclosure by being connected to a corresponding number of complementary shaped openings of the enclosure to provide a recreational play system environment, one or more said flexible tubes remain connected to the enclosure during movement.

11. A movable recreational equipment device, including:

an enclosure having multiple sides with an upper and lower end and an opening in one side for entry of an occupant;

proximate support structure immediately adjacent only one side of the enclosure having the opening for suspending the enclosure above a floor surface;

a spaced pair of U-shaped leaf springs connected between one side of the enclosure having the opening and the proximate support structure adjacent the lower end of the enclosure, said U-shaped leaf springs being constructed to restrict lateral movement while facilitating limited vertical movement of the enclosure; and a spaced pair of spring means extending between the one side of the enclosure having the opening and the proximate support structure adjacent the upper end of the enclosure, said spring means also facilitating limited vertical resilient movement of the enclosure relative to the proximate support structure when an occupant enters the enclosure.

12. The movable recreational equipment device as defined in claim 11 in which the U-shaped leaf springs have spaced legs and an intermediate bight portion, each of the spaced legs engaging the enclosure or support.

13. The movable recreational equipment device as defined in claim 12 in which one leg of each of the U-shaped leaf springs engages a vertical strut of the support in a vertically spaced position from one end of one of the spring means that engages the same vertical strut of the support.

14. The movable recreational equipment device as defined in claim 13 in which each of the spaced pair of spring means comprise coil springs attached at opposite ends to the support and enclosure.

15. The device as defined in claim 14 in which one or more flexible tubes are connected to the enclosure by being connected to a corresponding number of complementary shaped openings in the enclosure to provide a recreational play system environment, said one or more flexible tubes remaining connected to the enclosure during movement of the enclosure by an occupant.

* * * * *